US007049531B2

(12) United States Patent
Kondas et al.

(10) Patent No.: US 7,049,531 B2
(45) Date of Patent: May 23, 2006

(54) MODULAR ELECTRICAL COMPONENT WITH ELECTRICAL CIRCUIT SELECTOR ASSEMBLY

(75) Inventors: Shawn J. Kondas, Kendallville, IN (US); Daniel L. Hayes, Kendallville, IN (US)

(73) Assignee: Pent Technologies, Inc., Kendallville, IN (US)

( * ) Notice: Subject to any disclaimer, the term of this patent is extended or adjusted under 35 U.S.C. 154(b) by 142 days.

(21) Appl. No.: 10/824,085

(22) Filed: Apr. 14, 2004

(65) Prior Publication Data

US 2004/0238337 A1 Dec. 2, 2004

Related U.S. Application Data

(60) Provisional application No. 60/474,802, filed on May 29, 2003.

(51) Int. Cl.
*H01H 1/00* (2006.01)

(52) U.S. Cl. ..... 200/16 C; 200/16 D; 200/43.04; 200/51.09; 200/573; 200/283

(58) Field of Classification Search ..... 200/1 A, 200/16 C, 16 D, 43.04, 43.07, 43.08, 43.16, 200/51 R, 51.02, 51.03, 51.04, 51.09, 51.1, 200/283, 532, 535, 551, 558, 559, 568, 569, 200/573, 574

See application file for complete search history.

(56) References Cited

U.S. PATENT DOCUMENTS

| | | | | | |
|---|---|---|---|---|---|
| 4,767,355 | A | * | 8/1988 | Phillipson et al. | 439/425 |
| 5,280,254 | A | * | 1/1994 | Hunter et al. | 333/124 |
| 5,944,546 | A | * | 8/1999 | Miyake et al. | 439/188 |
| 5,944,547 | A | * | 8/1999 | Golab et al. | 439/188 |
| 6,130,387 | A | * | 10/2000 | Bricaud et al. | 200/43.04 |
| 6,435,887 | B1 | * | 8/2002 | Koitsalu | 439/188 |
| 6,612,856 | B1 | * | 9/2003 | McCormack | 439/188 |
| 6,638,087 | B1 | * | 10/2003 | Takada et al. | 439/188 |

* cited by examiner

*Primary Examiner*—Michael A. Friedhofer
(74) *Attorney, Agent, or Firm*—Taylor & Aust, P.C.

(57) ABSTRACT

A circuit selector assembly including an electrical conductor, an electrical contact, a first spring beam connected to the electrical contact and a second spring beam connected to the electrical contact. The second spring beam biases the electrical contact to a first position, the first spring beam being deflected when the electrical contact is in a second position, the second position being defined as when the electrical contact is contacting the electrical conductor.

17 Claims, 7 Drawing Sheets

MODULAR ELECTRICAL COMPONENT WITH ELECTRICAL CIRCUIT SELECTOR ASSEMBLY

CROSS REFERENCE TO RELATED APPLICATIONS

This is a non-provisional application based upon U.S. provisional patent application Ser. No. 60/474,802, entitled "ELECTRICAL TRACK BUSS SYSTEM AND ACTUATION DEVICE", filed May 29, 2003.

BACKGROUND OF THE INVENTION

1. Field of the Invention

The present invention relates to an electrical distribution system, and, more particularly, to a circuit selector assembly in an electrical distribution system.

2. Description of the Related Art

Electrical distribution systems are used in conjunction with modular office furniture and typically consist of a plurality of electrical distribution harnesses, which are respectively associated with wall panels, work surfaces, etc. The distribution harnesses include end connectors, which are coupled together using jumper cables. Each wiring harness also typically includes one or more output connectors, which are used for coupling with a modular electrical component, such as an electrical receptacle. Each output connector generally is in the form of a single row of terminals having ports, which are keyed to allow connection with only a particular type of electrical component. For example, a particular keying configuration for mating connectors ensures that only a particular one of multiple circuits within the wiring harness is connected therewith.

Track type electrical distribution systems are known in which an extruded track has a housing with a plurality of slots extending therein. Each separate slot carries a single conductor bar. An electrical component, such as an electrical receptacle, includes multiple different projections, which are respectively received within the multiple slots. Each projection electrically couples with a corresponding conductor bar in a corresponding slot. Although such track type distribution systems effectively provide power to a modular electrical component, the multiple different slots and corresponding projections may be relatively complicated to manufacture. Further, with many track type distribution systems, there are no provisions to ensure that the modular electrical component is correctly coupled with the conductor bars, so as to prevent incorrect coupling, for example with reverse polarity.

What is needed in the art is a system that is easy to manufacture and allows for reconfiguration of an entire track system in a simple manner.

SUMMARY OF THE INVENTION

The present invention provides an electrical circuit selector method and apparatus for use in a track wiring system.

The invention comprises, in one form thereof, an electrical circuit selector assembly including an electrical housing having at least one opening therein, the electrical housing having a first side and a second side. At least one electrical conductor is associated with the at least one opening on the first side and at least one circuit selector is positioned approximate to the at least one opening on the second side. The at least one circuit selector having a protrusion oriented to extend through the at least one opening and electrically contact at least one electrical conductor.

The invention comprises, in another form thereof, a method of selecting a circuit including applying a force to a first spring beam of a circuit selector; deflecting a second spring beam of the circuit selector as a result of the applying step; contacting an electrical element with a portion of the circuit selector; and deflecting the first spring beam thereby placing a predetermined force on the electrical element.

The present invention advantageously allows the installer to reconfigure a wiring harness associated with a track system.

Another advantage is that the track system can be configured by engaging actuators that are associated with separate circuit elements.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
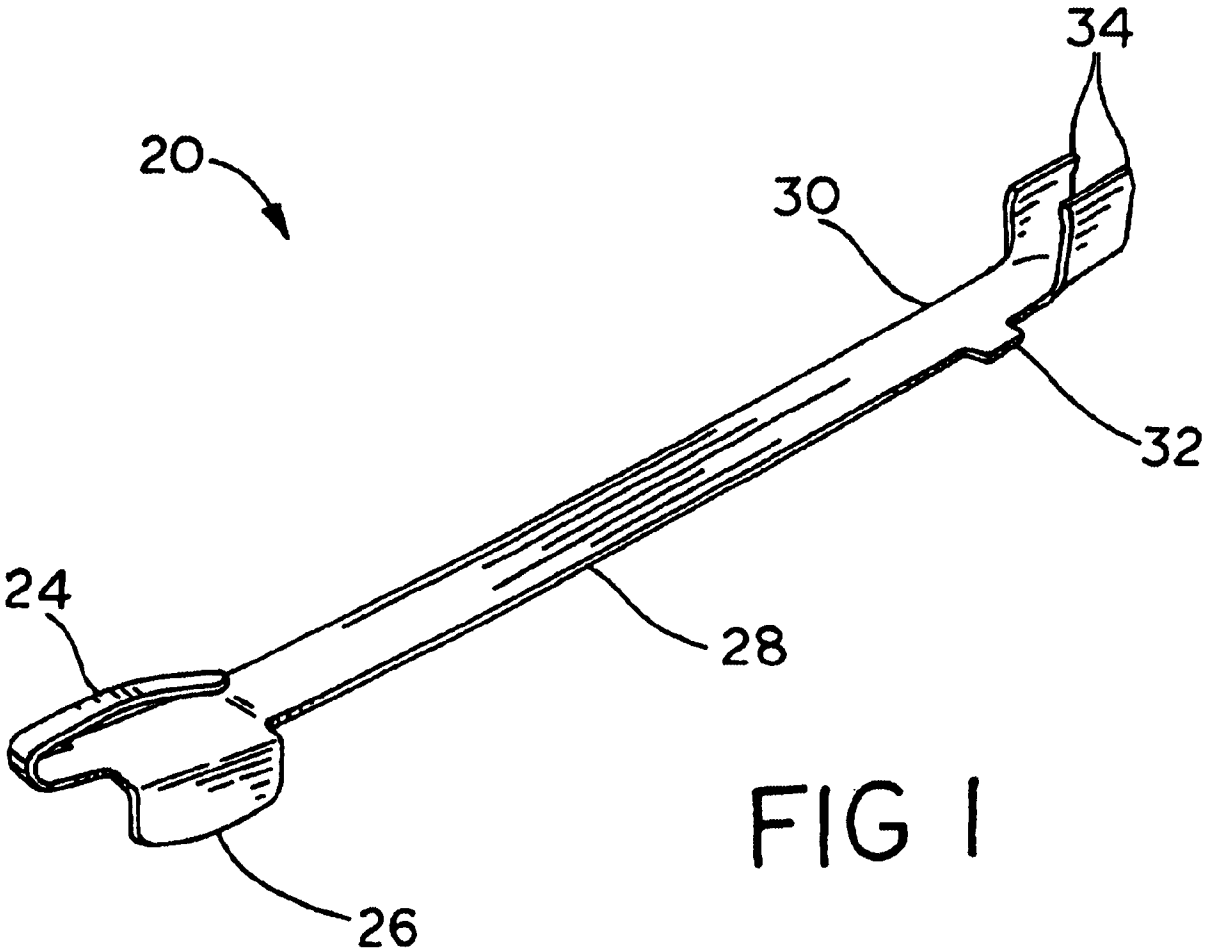
FIG. 1 is perspective view of a circuit selector utilized in an embodiment of the present invention.
Figure 2:
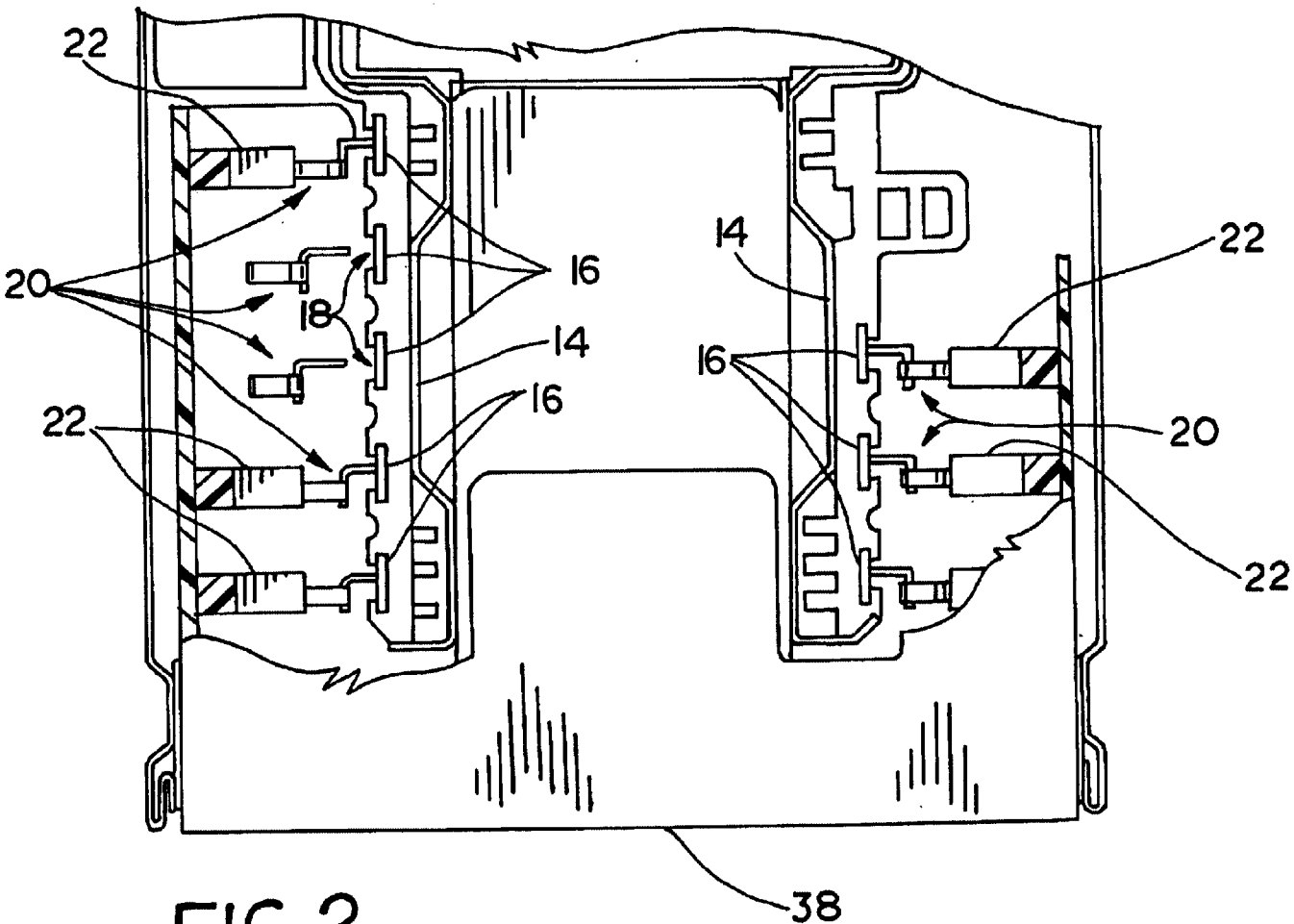
FIG. 2 is a partially sectioned view of multiple circuit selectors of FIG. 1 utilized in a circuit selection assembly.
Figure 3:
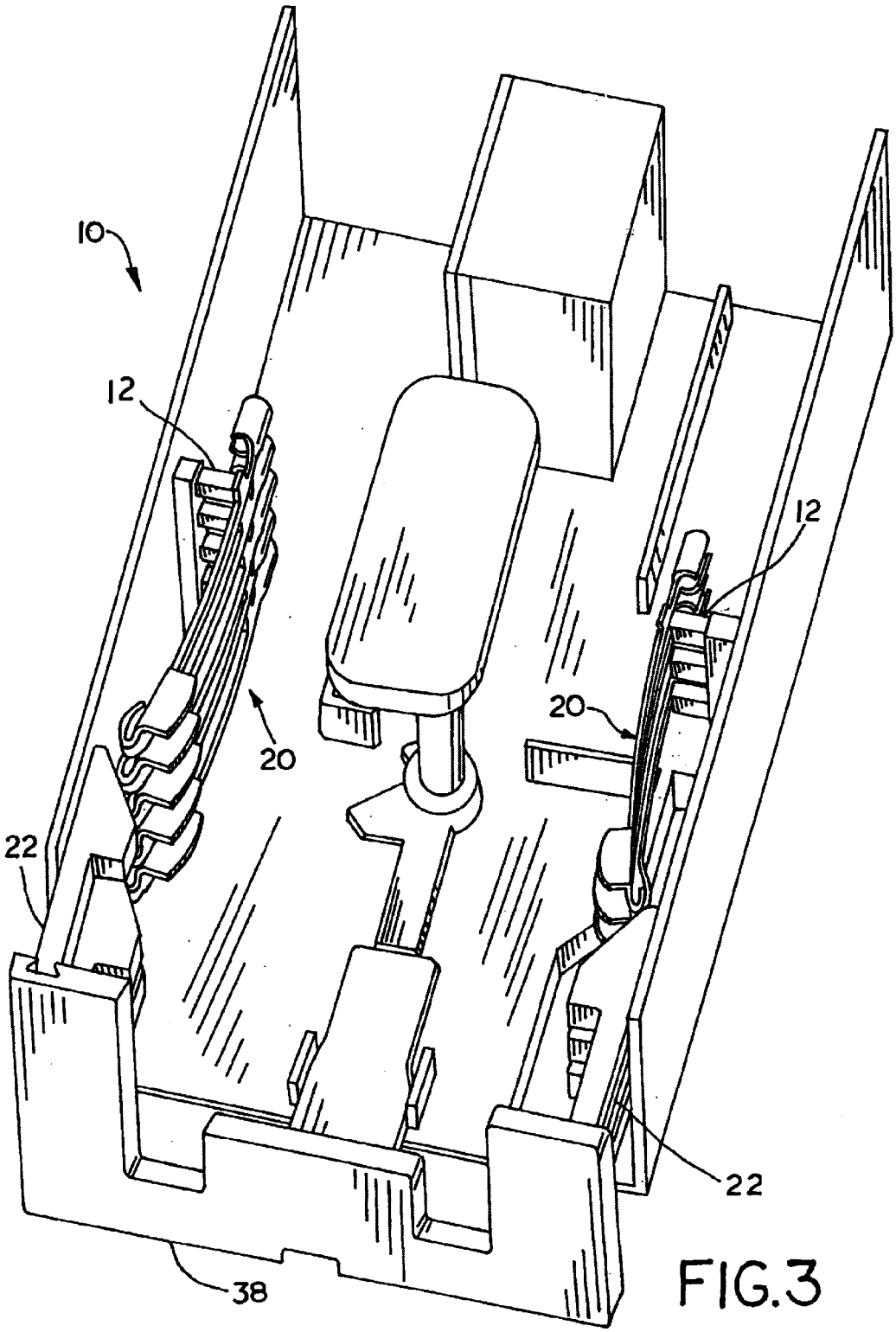
FIG. 3 is a perspective view of the assembly of FIG. 2 with a part of the assembly removed for the sake of clarity.
Figure 4:
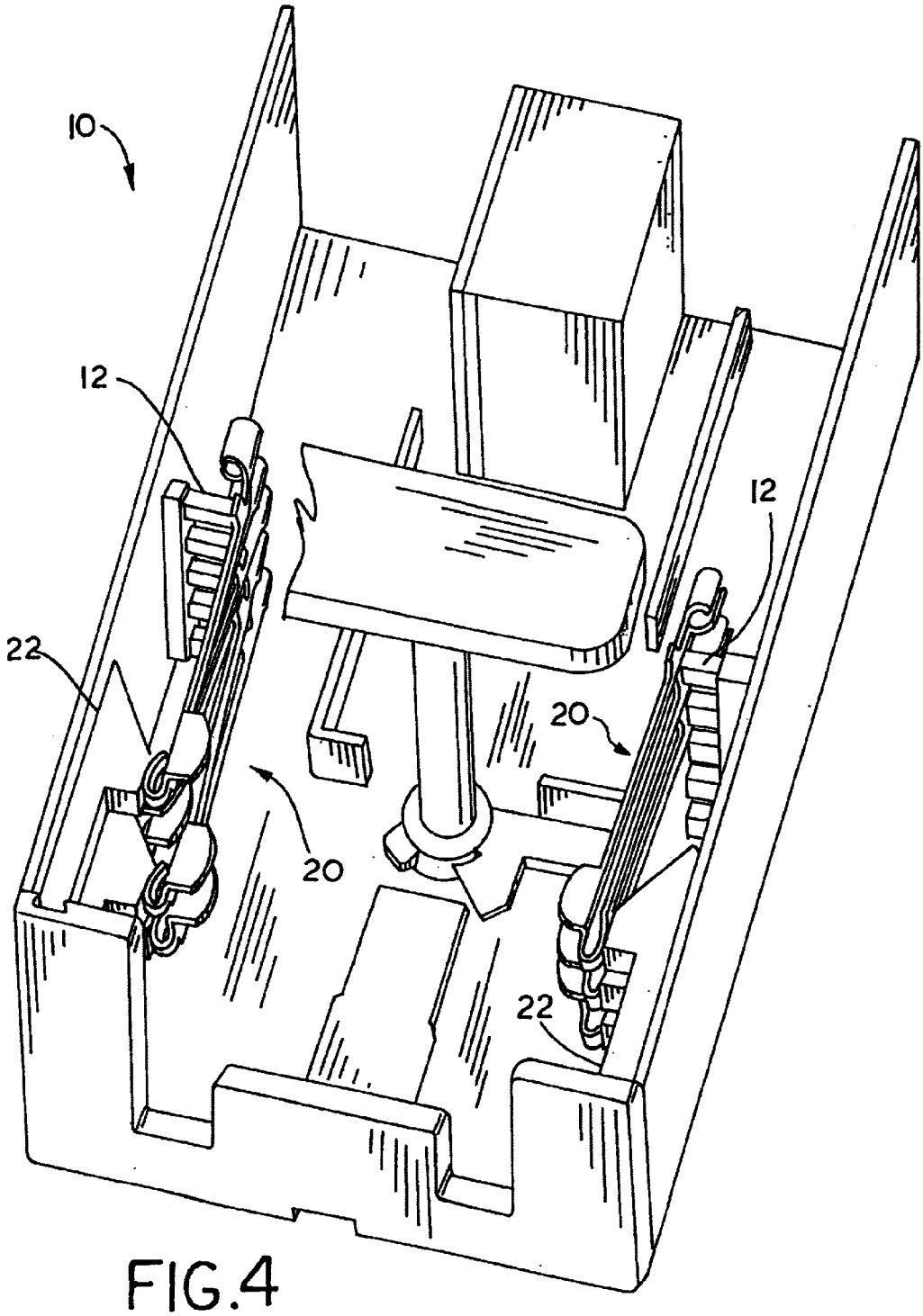
FIG. 4 is another perspective view of the assembly of FIG. 3 showing the actuation of some circuit selector elements.
Figure 5:
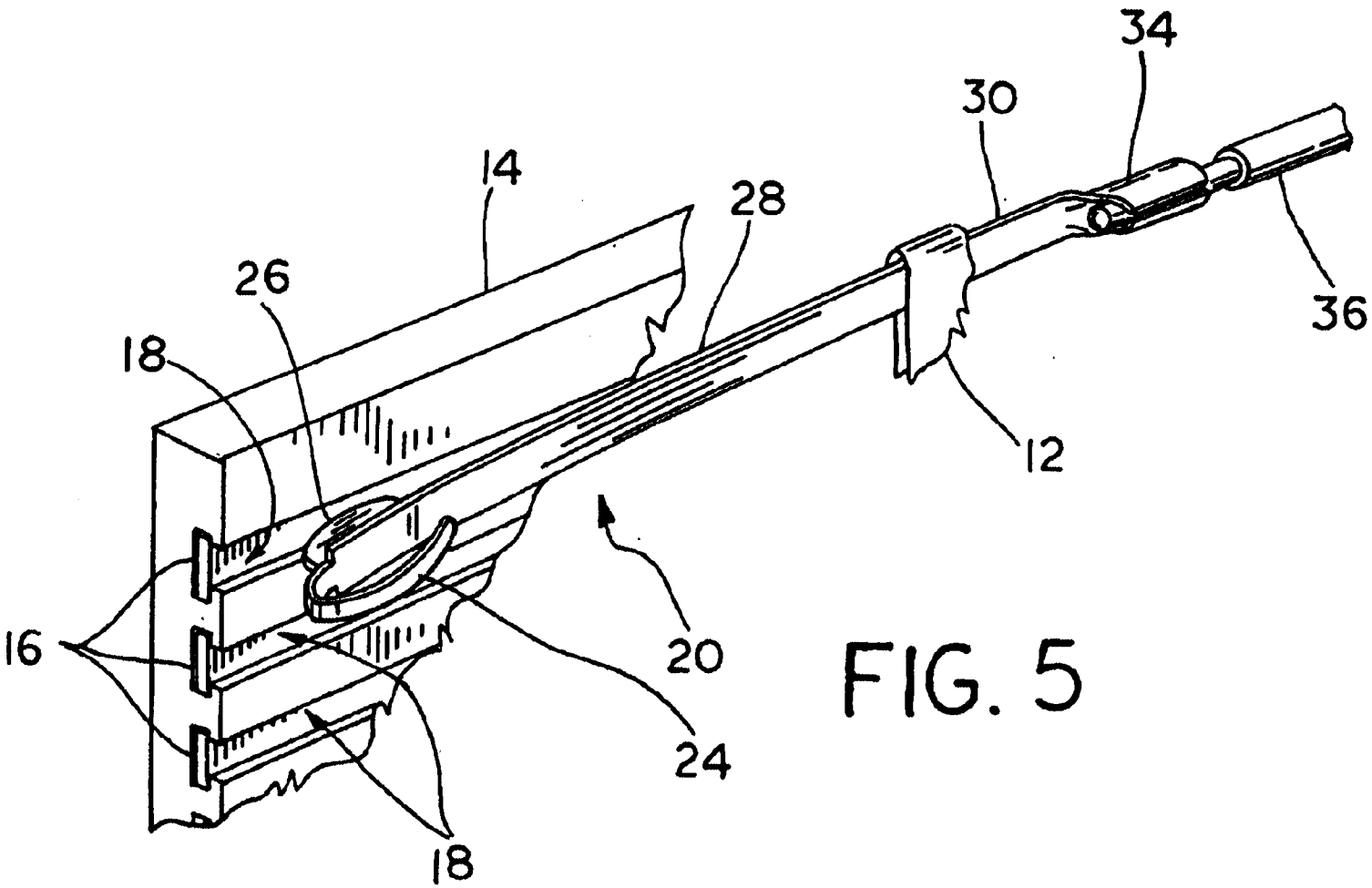
FIG. 5 is a perspective view of a single circuit selector element of FIG. 1.

Referring now to the drawings, and more particularly to FIGS. 1–5, there is shown a track wiring system 10 in the form of an electrical circuit selection assembly 10 including support structure 12, a housing 14, electrical conductors 16, openings 18, flexible selectors 20 and actuators 22.

Support structure 12 may be connected to housing 14 and it supplies positional support for selector 20. Support structure 12 may be indexed so as to position circuit selector 20 so that it can extend into an opening 18 and contact electrical conductor 16.

Housing 14 is a non-conductive material that positions electrical conductors 16 in a generally parallel manner with each other. Housing 14 includes an opening 18 that is associated with each electrical conductor 16. Openings 18 allow circuit selector 20 to electrically engage selected conductors 16 to thereby energize the electrical track system.

Circuit selectors 20 include an actuator interface 24 also known as a first spring beam 24, a contact protrusion 26, also known as an electrical contact 26, a mid-portion 28, also known as a second spring beam 28, a secured portion 30, an indexing protrusion 32, a crimp portion 34 and a wire 36 connected thereto.

Actuator interface 24 co-acts as a spring beam 24 so that an actuator 22, when encountering actuator interface 23, causes circuit selector 20 to flex at mid-portion 28. As circuit selector 20 engages electrical conductor 16 through opening 18 further insertion of actuator 22 causes actuator interface 24 to flex thereby applying a predetermined force to contact protrusion 26 against conductor 16 to thereby establish a reliable electrical contact. Contact protrusion 28 is shaped to easily clear the sides of opening 18 and to contact an electrical conductor 16 along a face of protrusion 26. Secured portion 30 is connected to support structure 12 and utilizes indexing protrusion 32 to orient circuit selector 20 so that protrusion 26 is properly positioned to enter opening 18 and that actuator interface 24 is properly positioned to encounter a corresponding actuator 22. Crimp portion 34 is crimped upon an electrical conductor 36 to thereby pass electrical current to or from electrical conductor 16 when circuit selector 20 is engaged with a corresponding electrical conductor 16. Multiple circuit selectors 20 are arranged in a track wiring system so that individual electrical circuits may be connected to selected corresponding electrical conductors 16.

Figure 7:
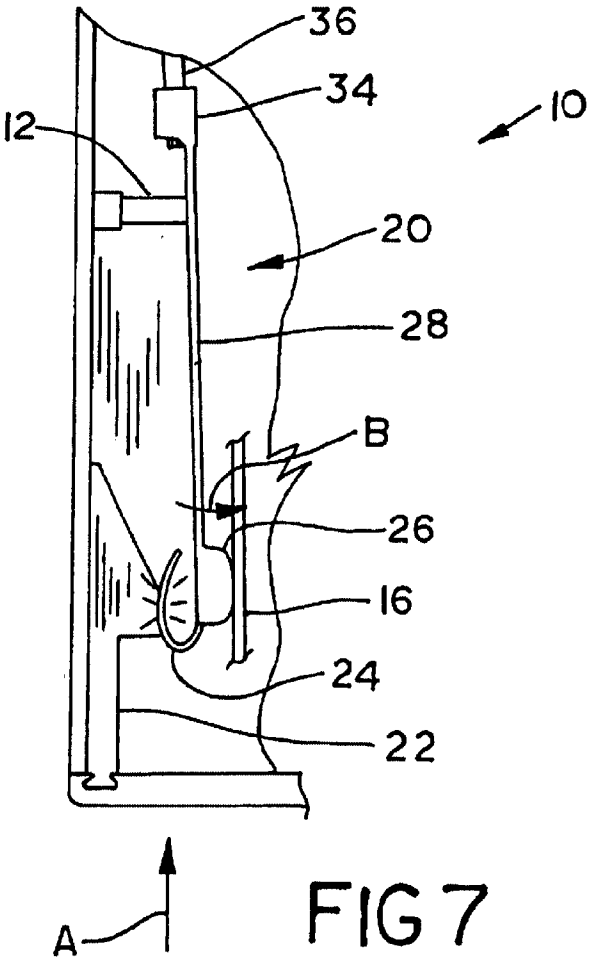
FIG. 7 is another view of the assembly of FIG. 6 showing a circuit selector element actuated.
Figure 6:
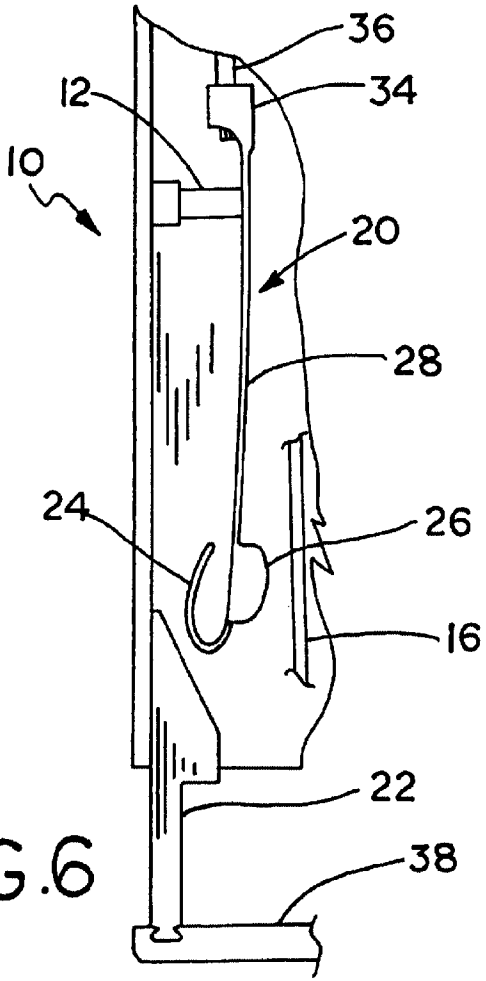
FIG. 6 is a partially sectioned schematical view of the circuit selector assembly and circuit selector of FIGS. 1–5.

Now, referring additionally to FIGS. 6 and 7, there is shown the actuation of a circuit selector 20 with a conductor 16. When actuators 22 are removed second spring beam 28 causes each circuit selector 20 to disengage from electrical conductors 16 thereby opening all electrical circuits that had been established. Actuators 22 are connected to plate 38 and are either adjustably positioned therein or can be simply removed by cutting or breaking them from plate 38. The adjustability of an actuator 22 or the removal of an actuator 22 can be utilized to configure the electrical power supplied to the track wiring system. For example, if certain power selectors are to be engaged to the track wiring system, as well as particular grounds and power returns, those actuators are left intact with either the removal or the adjustment of actuators 22, relative to plate 38, so that once actuators 22 are configured they are then inserted to engage the selected circuit selectors 20. This causes electrical power to be distributed within the electrical circuit selection assembly 10.

Actuator 22 applies an initial force against first spring beam 24, which substantially causes second spring beam 28 to bend as protrusion 26 approaches electrical conductor 16. Once protrusion 26 contacts conductor 16 further force directed against first spring beam 24 by actuator 22, causes first spring beam 24 to deflect to thereby ensure that a predetermined force is placed against conductor 16 by contact protrusion 26. The movement of plate 38 in direction A causes circuit selector 20 to move in direction B until the engagement of circuit selector 20 against a corresponding conductor 16. The movement of plate 38 in a direction opposite of direction A removes force from actuator interface 24, thereby allowing second spring beam 28 to return to its original position thereby disconnecting an electrical circuit.

Figure 8:
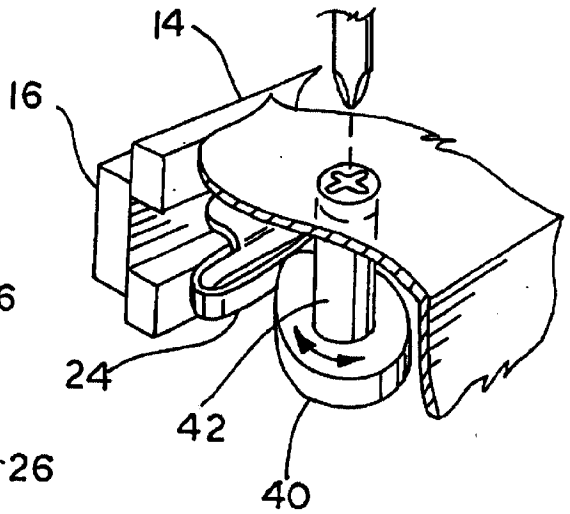
FIG. 8 is a perspective view of another embodiment of the circuit selector of the present invention.
Figure 9:
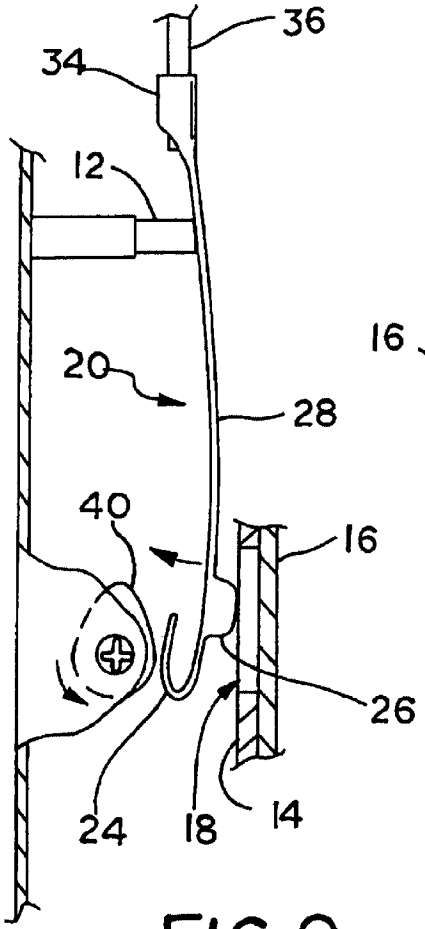
FIG. 9 is a partially sectioned schematic view of a circuit selector of FIG. 8.
Figure 10:
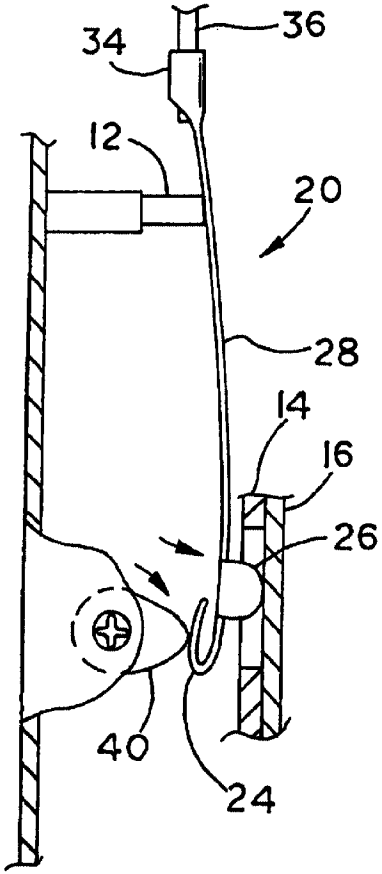
FIG. 10 is a partially sectioned schematic view of the circuit selector of FIG. 9 in an engaged position.

Now, additionally referring to FIGS. 8–10, there is shown another embodiment of electrical selection assembly 10 wherein actuator interface 24 is contacted by cam 40 having a shaft 42 with a Phillips type screw head. This arrangement allows engagement, by an installer, of a selected circuit by circuit selector 20. The installer rotates shaft 42 with a Phillips screwdriver thereby causing cam 40 to impinge against a portion of actuator interface 24 and bending second spring beam 28 until contact protrusion 26 contacts conductor 16. Cam 40 continues and places additional force on first spring beam 24 thereby causing it to flex and apply a predetermined force on contact protrusion 26 against conductor 16.

The system advantageously applies power to selected elements in electrical selection assembly 10 to thereby configure a track wiring system, which allows easy reconfiguration thereof.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical circuit selector assembly, comprising:

an electrical housing having at least one opening therein, said electrical housing having a first side and a second side;

at least one electrical conductor associated with said at least one opening on said first side; and at least one circuit selector positioned proximate to said at least one opening on said second side, said at least one circuit selector having a protrusion oriented to extend through said at least one opening and electrically contact at least one said electrical conductor said at least one circuit selector including:

a first end and a second end, said protrusion associated with said first end; and an actuator contact portion associated with said first end.

2. The assembly of claim 1, further comprising a support structure to which an end of said at least one circuit selector is secured, said end being generally opposite an other end of said at least one circuit selector, said other end associated with said protrusion.

3. The assembly of claim 1, wherein said at least one circuit selector further includes a flexibly resilient portion that bends when force is applied to said actuator contact portion, said flexibly resilient portion being between said first end and said second end.

4. The assembly of claim 3, further comprising a support structure to which said second end is attached.

5. The assembly of claim 4, wherein said at least one circuit selector further includes an indexing protrusion coacting with said support structure to orient said at least one circuit selector relative to said at least one opening.

6. The assembly of claim 1, wherein said actuator contact portion is one of curved and angled.

7. The assembly of claim 1, further comprising an actuator contacting said actuator contact portion to move said protrusion though said opening such that said protrusion contacts at least one electrical conductor.

8. The assembly of claim 7, wherein said actuator is nonconductive.

9. The assembly of claim 7, wherein said actuator is removably contacting said actuator contact portion.

10. An electrical circuit selector for contacting an electrical conductor through an opening in a nonconductive housing, the electrical circuit selector comprising:

a protrusion oriented to extend through the opening and electrically contact the electrical conductor;

a first end and a second end, said protrusion associated with said first end; and an actuator contact portion associated with said first end.

11. The selector of claim 10, further comprising a flexibly resilient portion that bends when force is applied to said actuator contact portion, said flexibly resilient portion being between said first end and said second end.

12. The selector of claim 11, further comprising an indexing protrusion associated with said second end, said indexing protrusion configured to orient said circuit selector relative to the opening.

13. The selector of claim 10, wherein said actuator contact portion is one of curved and angled.

14. A method of selecting an electrical circuit, comprising the steps of:

contacting an electrical conductor through an opening in a nonconductive housing with a portion of an electrical circuit selector, said portion including a protrusion oriented to enter said opening and electrically contact said electrical conductor;

wherein said electrical circuit selector includes a first end and a second end, said protrusion being associated with said first end and an actuator contact portion being associated with said first end.

15. The method of claim 14, further comprising the step of applying a force to said actuator contact portion thereby flexing a flexibly resilient portion of said electrical circuit selector, said flexibly resilient portion being between said first end and said second end.

16. A circuit selector assembly, comprising:

an electrical conductor;

an electrical contact;

a first spring beam connected to said electrical contact; and a second spring beam connected to said electrical contact, said second spring beam biasing said electrical contact to a first position, said first spring beam being deflected when said electrical contact is in a second position, said second position being defined as when said electrical contact is contacting said electrical conductor.

17. A method of selecting a circuit, comprising:

applying force to a first spring beam of a circuit selector;

deflecting a second spring beam of said circuit selector as a result of said applying step;

contacting an electrical element with a portion of said circuit selector; and deflecting said first spring beam thereby placing a predetermined force on said electrical element.

* * * * *

UNITED STATES PATENT AND TRADEMARK OFFICE

CERTIFICATE OF CORRECTION

PATENT NO. : 7,049,531 B2
APPLICATION NO. : 10/824085
DATED : May 23, 2006
INVENTOR(S) : Kondas et al.

It is certified that error appears in the above-identified patent and that said Letters Patent is hereby corrected as shown below:

COLUMN 4

At line 38, between “contact” and “at”, please insert --said--;
At line 38, after “one” and before “electrical”, please delete “said”;
At line 38, after “conductor” and before “said”, please insert --,--; and
At line 65, after “tacts” and before “at”, please insert --said--.

Signed and Sealed this

Twenty-seventh Day of March, 2007

JON W. DUDAS
*Director of the United States Patent and Trademark Office*